US012311231B2

(12) United States Patent
Trevas

(10) Patent No.: US 12,311,231 B2
(45) Date of Patent: May 27, 2025

(54) VARIABLE RESISTANCE APPARATUS AND RELATED EQUIPMENT AND METHODS

(71) Applicant: David A. Trevas, Houston, TX (US)

(72) Inventor: David A. Trevas, Houston, TX (US)

( * ) Notice: Subject to any disclaimer, the term of this patent is extended or adjusted under 35 U.S.C. 154(b) by 18 days.

(21) Appl. No.: 18/241,835

(22) Filed: Sep. 1, 2023

(65) Prior Publication Data

US 2025/0073534 A1 Mar. 6, 2025

(51) Int. Cl.

| | |
|---|---|
| ***A63B 24/00*** | (2006.01) |
| ***A63B 21/00*** | (2006.01) |
| ***A63B 21/005*** | (2006.01) |
| ***A63B 71/06*** | (2006.01) |

(52) U.S. Cl.

CPC ..... *A63B 24/0087* (2013.01); *A63B 21/0058* (2013.01); *A63B 21/4045* (2015.10); *A63B 71/0622* (2013.01); *A63B 2024/0068* (2013.01); *A63B 2024/009* (2013.01); *A63B 2024/0093* (2013.01); *A63B 2071/065* (2013.01); *A63B 2220/30* (2013.01); *A63B 2220/51* (2013.01); *A63B 2220/62* (2013.01)

(58) Field of Classification Search

None

See application file for complete search history.

(56) References Cited

U.S. PATENT DOCUMENTS

| | | | | |
|---|---|---|---|---|
| 4,774,879 | A | 10/1988 | Roedel | |
| 8,858,397 | B2 | 10/2014 | Ishii et al. | |
| 9,835,221 | B2 * | 12/2017 | Battlogg | F16F 13/007 |
| 9,951,840 | B2 * | 4/2018 | Battlogg | F16F 7/127 |
| 10,040,329 | B2 * | 8/2018 | Ericksen | B60G 17/08 |
| 10,265,581 | B2 | 4/2019 | O'Connor | |
| 10,426,997 | B2 | 10/2019 | Stewart | |
| 10,814,171 | B1 | 10/2020 | Kojayan | |
| 10,987,544 | B2 * | 4/2021 | Root, Jr. | A63B 71/0622 |
| 11,725,709 | B2 * | 8/2023 | Battlogg | F16F 9/535 188/267.2 |
| 2019/0111300 | A1 * | 4/2019 | Battlogg | B01D 69/14 |
| 2024/0131379 | A1 * | 4/2024 | Til | A63B 21/4049 |

FOREIGN PATENT DOCUMENTS

| | | | | |
|---|---|---|---|---|
| CN | 106693274 | A * | 5/2017 | |
| CN | 108302152 | A * | 7/2018 | F16F 9/535 |
| CN | 114791026 | A * | 7/2022 | |
| DE | 102014004997 | A1 | 10/2015 | |
| WO | WO 201746467 | A1 | 3/2017 | |

* cited by examiner

*Primary Examiner* — Angelisa L. Hicks

(74) *Attorney, Agent, or Firm* — Quisenberry Law PLLC

(57) ABSTRACT

Variable resistance devices and methods are disclosed. Resistance may be determined based on velocity of movement of a component in a variable resistance device. A variable resistance device may include a stator having a tapered internal bore and a plug disposed for longitudinal movement relative to the tapered internal bore to control resistance force. The tapered internal bore in the stator may be designed to yield a linear relationship between change in force and change in longitudinal movement of the plug relative to the tapered internal bore. The plug may be connected to a longitudinal rod movably disposed within a sleeve. The velocity at which the sleeve moves may be used to control movement of the plug relative to the tapered bore, and to thereby control resistance force. Variable resistance devices may be included as part of exercise equipment to control resistance force presented to a person using the equipment.

9 Claims, 13 Drawing Sheets

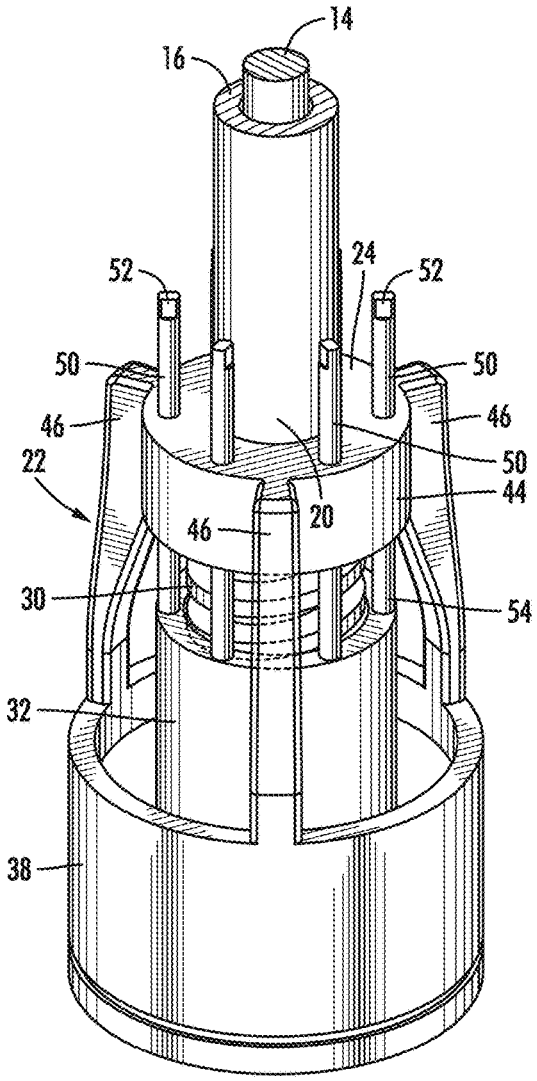
FIG.1
FIG.2
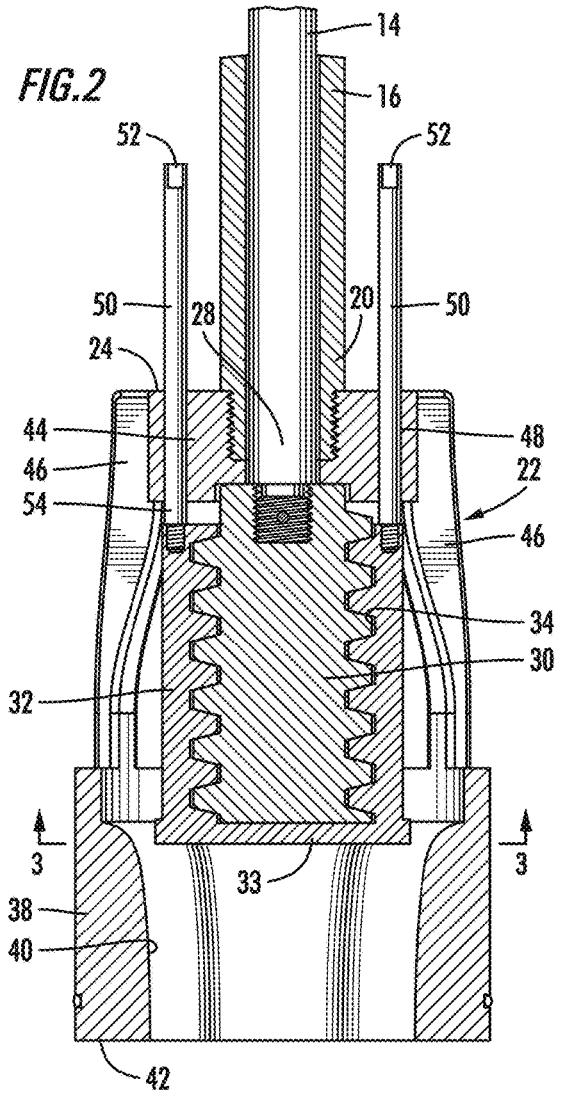
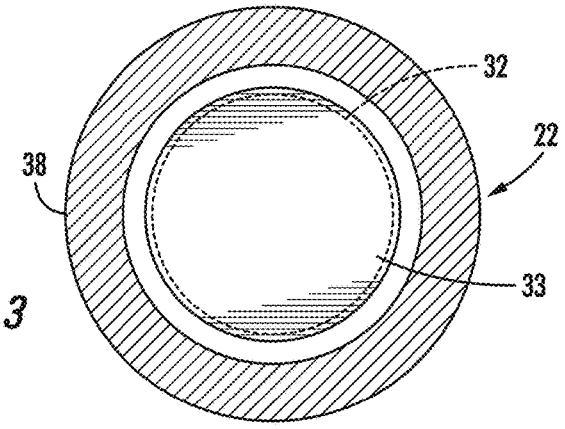
FIG.3

Force
Position
65
10
16
14
60
12
20
50
28
46
30
24
22
44
46
32
38
33
40
42
60
12b
64
69
36
62
62
26
18
58
56
12a
13
14
12
60
16
10

VARIABLE RESISTANCE APPARATUS AND RELATED EQUIPMENT AND METHODS

BACKGROUND OF THE INVENTIONS

1. Field of the Inventions

The present inventions generally pertain to variable resistance devices and methods.

2. Description of the Related Art

It is well known that current exercise equipment requires the user to select the force resistance before they start the exercise. For example, a common type of exercise equipment will include a vertical stack of weights such as rectangular plates with a removable pin that can be used to select the amount of weight the user will be lifting. By moving the pin up or down with respect to the stack of plates the user can select the number of plates (and thus the amount of weight) the user will be lifting. With this type of equipment, the user cannot select a weight heavier than they can lift at their weakest phase of the exercise. Suppose the item of exercise equipment is a military press. For this exercise, the user will sit on a bench and then grab two handles that are connected to the weights at shoulder height (this being the resting position), and then push the handles straight up as far as the user's arms will extend (this being the fully extended position). Suppose further that the user's arms or shoulders have an injury that has caused a weakest point at a particular point in the range of motion from the resting position to the fully extended position. This weakest point could also simply be a result of lack of mechanical advantage at that point, as opposed to injury. In either case, the maximum weight the user can select for this exercise is the amount of weight the user can lift at that weakest point in the range of motion. The user could lift more weight on either side of that weakest point. But because of the design of current exercise equipment, the user cannot exercise muscles at a higher weight or resistance in the strong phases on either side of that weakest point in the full range of motion of the exercise. The effect of this limitation is that the user is exerting less effort at the strong phases. This wastes motion and time, and for those dealing with injuries or ailments, it can aggravate their problems.

As will become apparent from the description and explanation set forth below, the present inventions overcome the above-described problem by providing exercise equipment that will expose the user to less resistance at the weakest point in their range of motion for the particular exercise, and will expose the user to greater resistance in the strong phases of the range of motion. But the present inventions are not confined to use in connection with exercise equipment, but have numerous other uses outside of and unrelated to exercise equipment. More broadly, as discussed below, the present inventions encompass various embodiments of variable resistance devices and related methods that may be useful not only in connection with exercise equipment, but in various other applications.

SUMMARY OF THE INVENTIONS

In one aspect, the present inventions may include a variable resistance apparatus comprising a sealed, enclosed housing having a first end and containing a fluid, a sleeve having a first end secured to the first end of the enclosed housing, and extending into the enclosed housing, a longitudinal rod having a first end and a second end, the longitudinal rod being disposed for rotatable and telescoping movement within the sleeve, a stator disposed within the enclosed housing and fluid, an upper end of the stator being connected to a second end of the sleeve, the stator having a lower housing including a tapered internal bore, a threaded rotor disposed within the stator, the threaded rotor being connected to the second end of the longitudinal rod, a plug disposed within the stator and fluid, the plug having an upper opening, an internal bore, and an enclosed lower end, the internal bore including internal threads adapted for threadable engagement with the threaded rotor, a motor mounted adjacent the first end of the sleeve and connected to the first end of the longitudinal rod, the motor being adapted to impart rotational movement to the longitudinal rod, wherein rotation of the longitudinal rod in a first direction will cause the threaded rotor to rotate in a first direction and cause the plug to move downwardly within the tapered internal bore in the lower housing of the stator, and rotation of the longitudinal rod in a second direction will cause the threaded rotor to rotate in a second direction and cause the plug to move upwardly relative to the tapered internal bore in the lower housing of the stator. Another feature of this aspect of the present inventions may be that the tapered internal bore of the lower housing on the stator yields a linear relationship between change in force and change in longitudinal movement of the plug within the lower housing of the stator. Another feature of this aspect of the present inventions may be that apparatus may further include at least one guide rod connected to an upper end of the plug and disposed for reciprocating movement within a guide bore in an upper plate of the stator. Another feature of this aspect of the present inventions may be that the apparatus may further include a monitor to display force versus time. Another feature of this aspect of the present inventions may be that an increase in speed of telescoping movement of the sleeve will cause the motor to rotate the longitudinal rod in the first direction to increase resistance force, and a decrease in speed of telescoping movement of the sleeve will cause the motor to rotate the longitudinal rod in the second direction to decrease resistance force. Another feature of this aspect of the present inventions may be that the apparatus may further include a controller to control rotatable movement of the longitudinal rod to control the position of the plug relative to the tapered internal bore of the lower housing in the stator based on speed of the sleeve as it moves.

In another aspect, the present inventions may include a variable resistance valve comprising: a sealed housing filled with a fluid; a stator disposed within the housing and fluid, and having a lower housing including a tapered internal bore; and a plug disposed for longitudinal movement within the stator relative to the tapered internal bore; wherein the tapered internal bore of the lower housing on the stator yields a linear relationship between change in force and change in longitudinal movement of the plug within the lower housing of the stator. Another feature of this aspect of the present inventions may be that the apparatus may further include a rotatable rod having a threaded end threadably engaged with an internal threaded bore of the plug, wherein rotation of the rod causes longitudinal movement of the plug within the tapered internal bore of the lower housing of the stator. Another feature of this aspect of the present inventions may be that the position of the plug within the stator varies based on how fast the stator and plug are moving together in unison.

In another aspect, the present inventions may include an exercise method comprising: exerting a force along a fixed path to move an object; detecting the speed at which the object is being moved; determining a difference between the detected speed and a target speed; controlling a resistance force applied to the object to maintain the movement speed of the object at the target speed; displaying the force exerted as a function of position of the object on the fixed path; and recording the force exerted and corresponding position of the object for the duration of movement of the object. Another feature of this aspect of the present inventions may be that exercise method may further include displaying one or more of a prior resistance force applied to the object in a prior performance of the exercise method, an average of resistance forces applied to the object over the course of at least two performances of the exercise method, a best force applied to the object over the course of at least two performances of the exercise method, and a most recent force applied to the object over the course of at least two performances of the exercise method.

In another aspect, the present inventions may include an exercise apparatus comprising: a frame, a variable resistance device having a longitudinal rod and a tube, the longitudinal rod being disposed for movement within the tube, the tube being secured to the frame, and a support connected to the longitudinal rod, whereby movement of the support will cause movement of the longitudinal rod relative to the tube and adjust a resistance force imparted to the support by the variable distance device based on the speed of movement of the longitudinal rod. Another feature of this aspect of the present inventions may be that the resistance force is adjusted to maintain a predetermined speed of movement of the longitudinal rod. Another feature of this aspect of the present inventions may be that apparatus may further include a monitor to provide real-time feedback of a user's effort as a function of the resistance force and position of the support. Another feature of this aspect of the present inventions may be that the variable resistance device includes: a stator having a lower housing including a tapered internal bore; a plug connected to the longitudinal rod and disposed for longitudinal movement within the stator relative to the tapered internal bore; wherein the tapered internal bore of the lower housing on the stator yields a linear relationship between change in force and change in longitudinal movement of the plug within the lower housing of the stator. Another feature of this aspect of the present inventions may be that the longitudinal rod has a threaded end threadably engaged with an internal threaded bore of the plug, wherein rotation of the rod causes longitudinal movement of the plug within the tapered internal bore of the lower housing of the stator. Another feature of this aspect of the present inventions may be that the apparatus may further include a sleeve having a first end secured to a first end of an enclosed housing, and extending into the enclosed housing, the longitudinal rod having a first end and a second end, the longitudinal rod being disposed for rotatable and telescoping movement within the sleeve, a stator disposed within the enclosed housing, an upper end of the stator being connected to a second end of the sleeve, the stator having a lower housing including a tapered internal bore, a threaded rotor disposed within the stator, the threaded rotor being connected to the second end of the longitudinal rod, a plug disposed within the stator, the plug having an upper opening, an internal bore, and an enclosed lower end, the internal bore including internal threads adapted for threadable engagement with the threaded rotor, and a motor mounted adjacent the first end of the sleeve and connected to the first end of the longitudinal rod, the motor being adapted to impart rotational movement to the longitudinal rod, wherein rotation of the longitudinal rod in a first direction will cause the threaded rotor to rotate in a first direction and cause the plug to move downwardly within the tapered internal bore in the lower housing of the stator, and rotation of the longitudinal rod in a second direction will cause the threaded rotor to rotate in a second direction and cause the plug to move upwardly relative to the tapered internal bore in the lower housing of the stator. Another feature of this aspect of the present inventions may be that the tube is a non-ferromagnetic tube and the longitudinal rod is a non-conductive rod, and the apparatus may further include a solenoid disposed for movement within the tube and attached to the longitudinal rod, the solenoid including a first electrical wire adapted for connection to a source of electricity and a second electrical wire connected to a controller adapted to adjust current in the solenoid based on speed of movement of the longitudinal rod to adjust the resistance force to maintain a target speed of movement of the longitudinal rod.

In another aspect, the present inventions may include an exercise system comprising: a computer processor coupled to memory, the memory storing instructions that when executed by the computer processor causes the computer processor to: (a) detect an initial force; (b) record an initial time, an initial position and the initial force; (c) set a counter to zero; (d) record current time, current position, and current force; (e) display force and position on a screen; (f) calculate velocity; (g) calculate an error based on a difference between the calculated velocity and a target velocity; (h) use the error to adjust resistance; (i) determine whether an end condition has been reached; and (j) if an end condition has not been reached, then store a current time, current position, and current force, increase the counter by one, and repeat steps (d) through (i) until an end condition has been reached, and then display exercise data. Another feature of this aspect of the present inventions may be that the step of using the error to adjust resistance includes rotating a longitudinal rod to move a plug up and down with a lower housing of a stator. Another feature of this aspect of the present inventions may be that data is processed and displayed by: (k) reading the stored data for position, time and force; (l) setting an initial force to a maximum force read from the stored data; (m) setting a maximum power to zero; (n) setting a total work to zero; (o) setting a step counter to zero; (p) calculating current velocity; (q) calculating an average velocity; (r) calculating current work completed; (s) calculating total work; (t) calculating instantaneous power; (u) determining whether an average force is greater than the maximum force; (v) if the average force is greater than the maximum force, then setting the average force equal to the maximum force, but if the average force is not greater than the maximum force, then: (w) determining whether current power is greater than the maximum power; (x) if the current power is greater than the maximum power, then setting the maximum power equal to the current power, but if the current power is not greater than the maximum power, then: (y) determine if all data has been processed; (z) if all data has not been processed, then increasing the step counter by one and repeating steps (p) through (y) until the answer at step (y) is yes, then: (aa) calculating average power; and (bb) displaying total work, average power, maximum power, and maximum force.

Other features, aspects and advantages of the present inventions will become apparent from the following discussion and detailed description.

BRIEF DESCRIPTION OF THE DRAWINGS

FIG. 1 is a perspective view of a specific embodiment of a portion of a specific embodiment of a variable resistance apparatus constructed in accordance with one aspect of the present inventions.

FIG. 2 is a cross-sectional side view of the apparatus shown in FIG. 1 and showing a plug in an upper position.

FIG. 3 is a cross-sectional view taken along line 3-3 in FIG. 2.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figure 6:
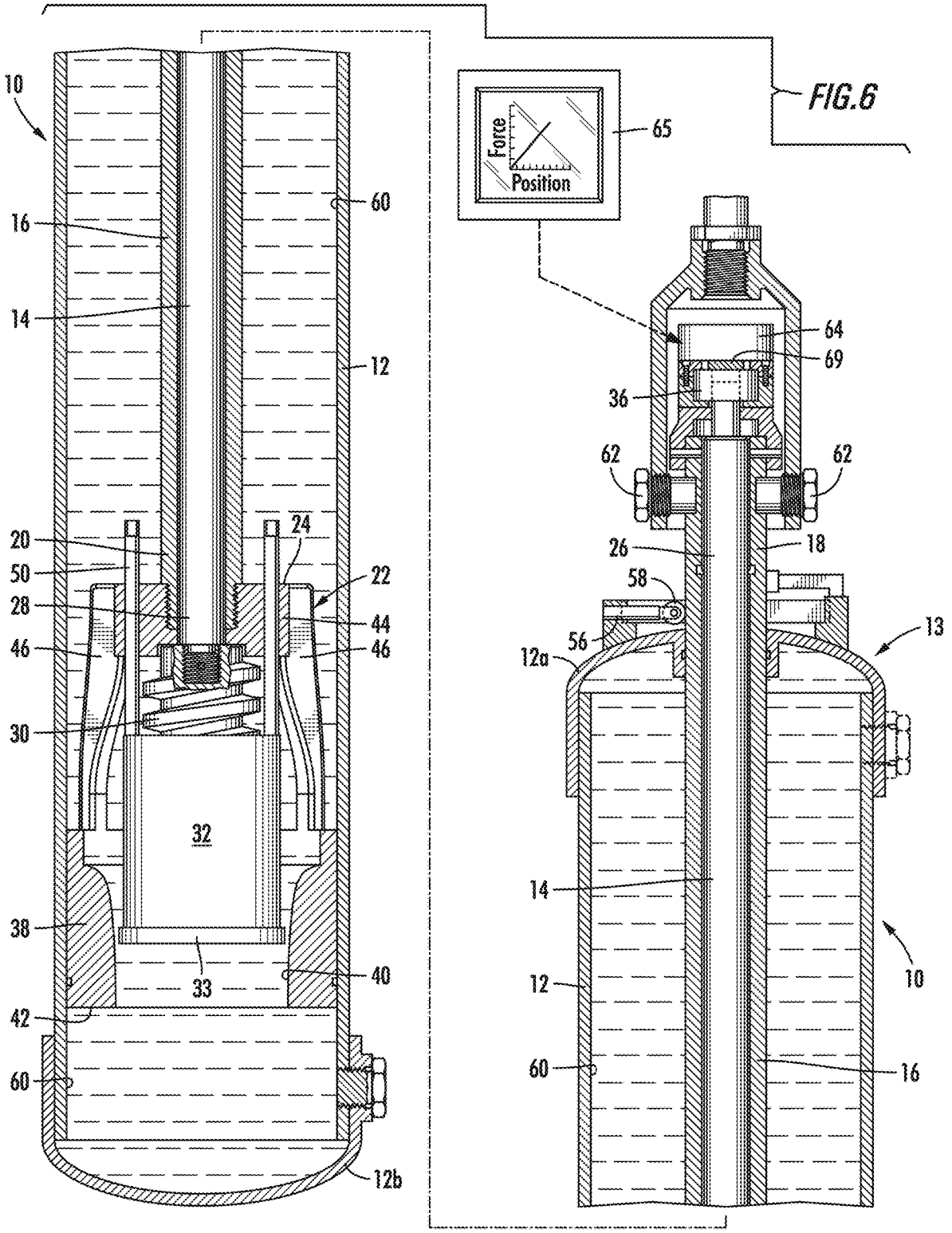
FIG. 6 is a cross-sectional side view of a specific embodiment of a variable resistance apparatus, which may be adapted for use in connection with a specific embodiment of an exercise apparatus constructed in accordance with one aspect of the present inventions.

Referring to the drawings in detail, wherein like numerals denote identical elements throughout the several views, a specific embodiment of a variable resistance apparatus 10 will now be described with reference to FIGS. 1-6. Referring initially to FIG. 6, it can be seen that the variable resistance apparatus 10 may include an enclosed housing 12 and a longitudinal rod 14. The longitudinal rod 14 may have a first end 26 and a second end 28. In a specific embodiment, the enclosed housing 12 may be enclosed in a sealed manner with upper and lower end caps 12*a* and 12*b*. The enclosed housing 12 is filled with a fluid, such as water, air, or any liquid or gas. The longitudinal rod 14 may be disposed for rotatable and telescoping movement within a sleeve 16 having a first end 18 secured to a first end 13 of the enclosed housing 12. A second end 20 of the sleeve 16 may be secured to a stator 22 at an upper end 24 thereof. The stator 22 is disposed within the enclosed housing 12 and immersed within the fluid. The second end 28 of the longitudinal rod 14 may be attached to a threaded rotor 30. The threaded rotor 30 is adapted for threadable engagement with a plug 32 having internal threads 34. The plug 32 is disposed for movement within the stator 22, and is therefore also disposed within the enclosed housing 12 and immersed within the fluid. A lower end of the plug 32 may be enclosed with a bottom circular plate 33. A motor 36 (such as a servo motor or a stepper motor, for example) that is mounted adjacent the first end 18 of the sleeve 16, and connected to the first end of the longitudinal rod 14, is adapted to impart rotational movement in either direction to the longitudinal rod 14. Rotation of the longitudinal rod 14 in a first direction will cause the plug 32 to move downwardly, and rotation of the longitudinal rod 14 in a second direction (opposite to the first direction) will cause the plug 32 to move upwardly.

In a specific embodiment, a load cell 69 may be provided, such as adjacent the motor 36, to detect forces. The load cell 69 may be used by a manufacturer of equipment, for example. In a specific embodiment, there may be a correlation between the force exerted versus the speed of advance (or retraction) and the axial location of the plug 32. In a specific embodiment, once a machine is calibrated, consumer versions of the machine will have the force calculated rather than measured separately, such as using the load cell 69. In a specific embodiment, the load cell 69 may be positioned to detect the amount of force being applied by a user, such as through handles 148, as discussed elsewhere herein. Again, in a specific embodiment, the force may be calculated instead of measured, such as with the load cell 69.

Figure 4:
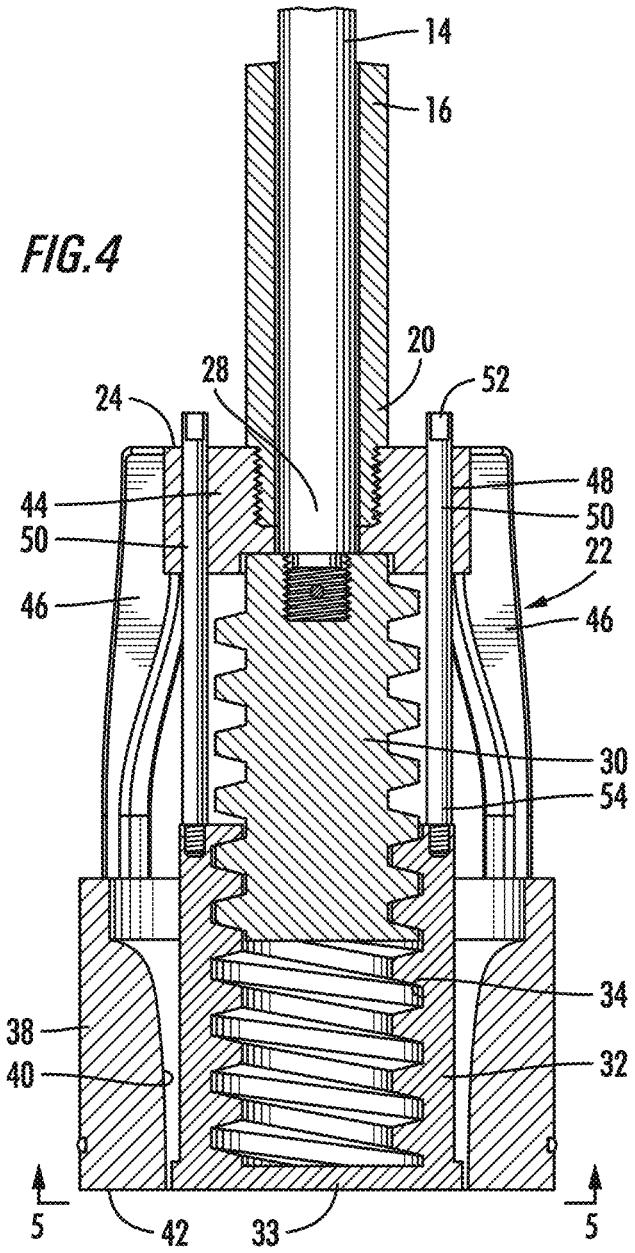
FIG. 4 is a cross-sectional side view similar to FIG. 2, but with the plug in a lower position.
Figure 5:
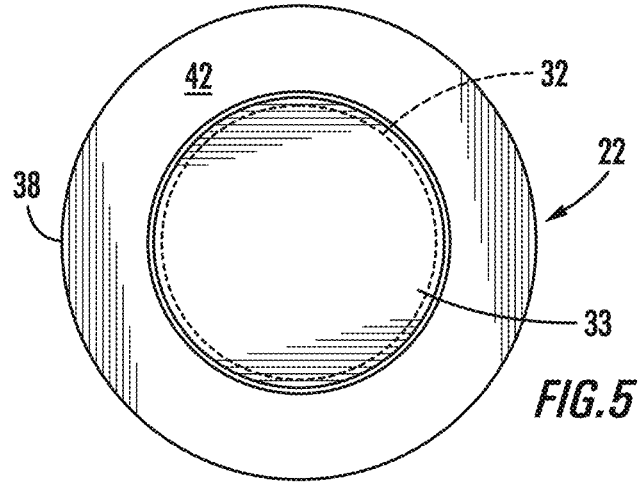
FIG. 5 is a bottom view of the apparatus shown in FIG. 4 and taken along line 5-5 in FIG. 4.

With reference to FIG. 2, the stator 22 may include a lower housing 38 having a tapered internal bore 40. The lower housing 38 may be adapted for close engagement with an inner bore 60 of the enclosed housing 12, and for longitudinal movement within the enclosed housing 12. The diameter of the tapered internal bore 40 gradually increases moving upwardly from a lower end 42 of the lower housing 38. The shape of the tapered internal bore 40 may be determined in accordance with a formula, as further discussed below. In a specific embodiment, the diameter of the bottom circular plate 33 on the plug 32 is slightly smaller than the diameter of the tapered internal bore 40 at the lower end 42 of the lower housing 38. In a specific embodiment, the clearance between the bottom circular plate 33 and the tapered internal bore 40 at the lower end 42 of the lower housing 38 may be close to zero. The plug 32 is adapted for longitudinal (e.g., upward and downward) movement within the tapered internal bore 40 of the stator 22. When the plug 32 is in a lowermost position (as shown in FIG. 4) such that the bottom plate 33 of the plug 32 is adjacent the lower end 42 of the lower housing 38, the clearance between the bottom circular plate 33 and the tapered internal bore 40 is at its smallest. As the plug 32 moves upwardly toward an upper position as shown in FIG. 2, the clearance between the bottom circular plate 33 on the plug 32 and the tapered internal bore 40 in the stator 22 gradually increases. The reason this is important is because the stator/plug/rotor assembly is submerged in fluid that fills an inner chamber of the enclosed housing 12, as mentioned above and will be discussed in more detail below.

With reference to FIGS. 1 and 2, in a specific embodiment, the stator 22 may include an upper plate 44 that is supported by a plurality of vertical support members 46, that in turn may be supported by the lower housing 38. The second end 20 of the sleeve 16 may be threadably secured to the upper plate 44. The upper plate 44 may include a bore for receiving the second end 28 of the longitudinal rod 14, which, as described above, may be secured to the threaded rotor 30. The upper plate 44 may include at least one guide bore 48 and at least one guide rod 50 that may be disposed for longitudinal movement up and down within the at least one guide bore 48. A first or upper end 52 of each guide rod 50 may extend above an upper surface of the upper plate 44. A second or lower end 54 of each guide rod 50 may be threadably engaged with an upper end of the plug 32. In this manner, the plug 32 will move up and down in a linear path and rotation of the plug 32 relative to the stator 22 will be prevented.

Figure 18:
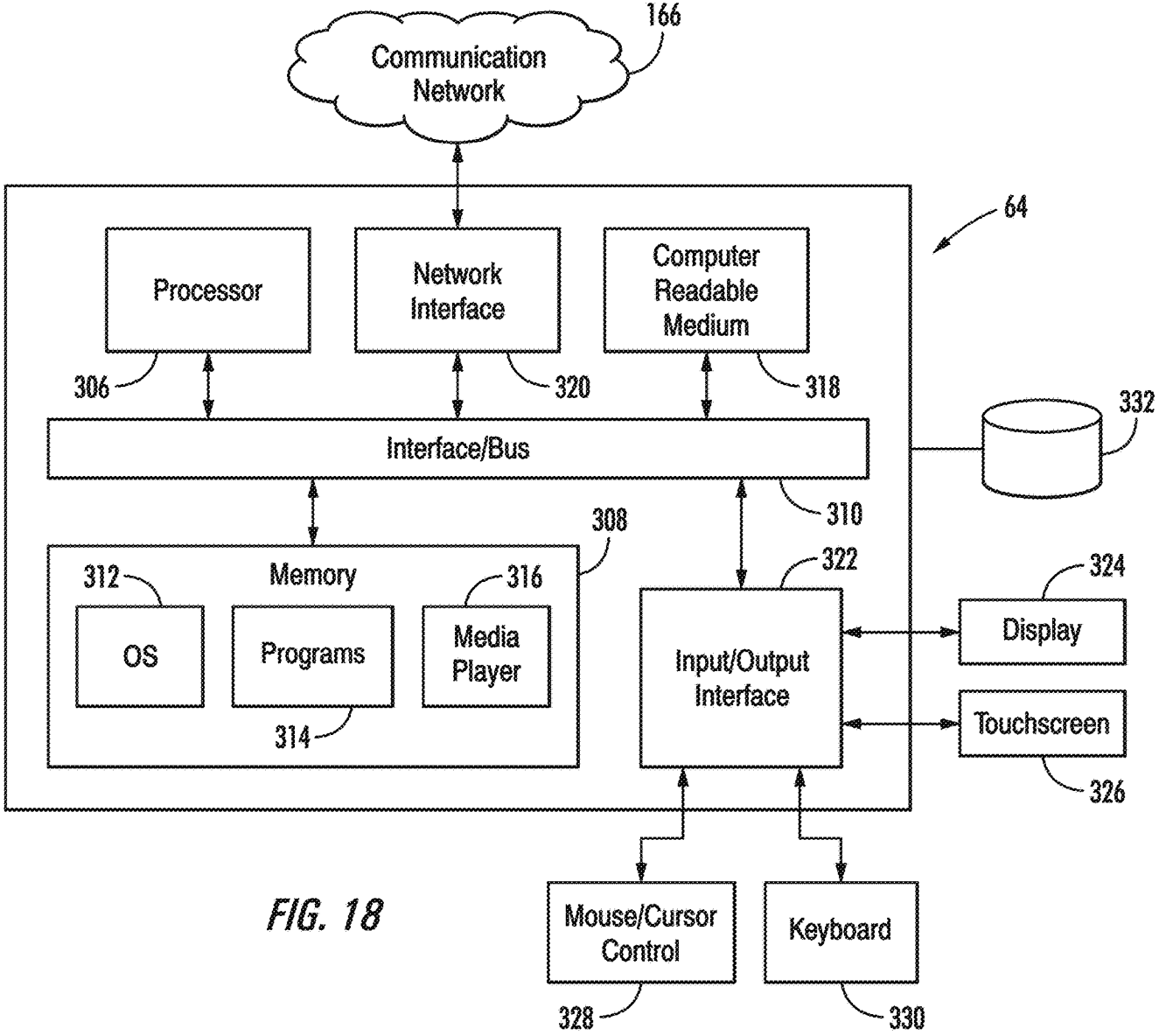
FIG. 18 is a schematic representation of a computer that may be used to implement all or part of the present inventions.

With reference to FIG. 6, in a specific embodiment, the variable resistance apparatus 10 may include a speed measurement device 56 that may include a rotatable wheel 58 engaged with an outer surface of the sleeve 16 at a location above or exterior to the enclosure housing 12, such as above the upper cap 12*a*. The wheel 58 functions to measure the speed of the sleeve 16 (and attached stator 22, rotor 30, and plug 32) as it moves up and down (back and forth) in response to pushing, pulling, lifting, etc. forces imparted to the sleeve 16. In a specific embodiment, a predetermined speed of the sleeve (or other structural device) may be input or otherwise established or pre-set, and then the resistance may be correlated to maintain the predetermined speed. In a specific embodiment, forces may be imparted to the sleeve 16 via handles 148 shown for example in FIG. 12 that may be attached at connection points 62 shown in FIG. 6, such as by the person using an exercise apparatus such as equipment 130 shown in FIG. 12 according to the present inventions, for example. The speed measurement device 56 is in electrical communication with a controller 64 (e.g., a computer, processor, microprocessor, etc., such as shown in FIG. 18 and discussed below). Depending on the speed detected, the controller 64 will cause the longitudinal rod 14 to be rotated clockwise or counterclockwise by the motor 36, resulting in longitudinal movement of the plug 32 relative to the tapered internal bore 40 of the lower housing 38, to thereby vary the resistance force imparted to the handles 148. In a specific embodiment, the resistance force is varied based on the detected speed to maintain a target or predetermined speed. A display 65 may be in communication with the controller 64, which may be programmed to display a graph showing the linear relationship between force and position that is a characteristic of the present inventions. As discussed in more detail below, the graph may be shown on a monitor and created in real time to provide instantaneous feedback of force as a function of position.

The position of the plug 32 (which has a fixed diameter) relative to the tapered internal bore 40 will vary the annular flow area within the stator 22 (which has a variable internal diameter) and determine how much force is presented, such as to someone exercising on an item of exercise equipment incorporating a variable resistance apparatus in accordance with the present inventions. The resistance will be created from the head loss of a constant flow being forced through restriction defined by the annular space between the outer surface of the plug 32 and the tapered internal bore 40. As mentioned above, the tapered internal bore 40 may be analytically generated to cause the variation in force to be linearly proportional to the axial position of the plug 32.

In a specific embodiment, the profile of the annular flow restriction defined by the tapered internal bore 40 provides for a linear relationship between pressure drop and axial position of the plug 32. In a constant cross-section tube, the pressure drop is proportional to the force. The variable resistance valves of the present inventions contrast with a linear control valve in that those linear control valves are designed to have a linear relationship between flow rate and axial position of the plug. On the other hand, the variable resistance valves of the present inventions establish a linear relationship between the velocity squared and position. In a specific embodiment, the tapered internal bore 40 of the lower housing 38 on the stator 22 yields a linear relationship between change in force and change in longitudinal movement of the plug 32 within the lower housing 38 of the stator 22. The importance of this linear relationship is based in control theory. To analyze a closed-loop control system, it is necessary to use a linear or non-linear model depending on the real-world behavior of the elements of system. Non-linear models are much more difficult, so to get better, faster and more reliable control, a linear model is much better if it can be applied validly.

The force, F, due to the pressure drop across a restriction is proportional to the square of the velocity, V, in the simplified case. (In general, geometric and Reynolds number effects will alter this relationship.). The mean flow velocity is $F \propto V^2$, $V=Q/A$, where Q is the volumetric flow rate in $L^3/T$ units and A is the cross-sectional area in $L^2$ units. For the annular system, R is the fixed radius of the inner plug that can move axially in the x direction. The profile of the outer nozzle, r(x), is determined by a function of x. $A=\pi(r(x)^2-R^2)$. To get the behavior where $V^2$ varies linearly with x, the following expression is proposed:

$$r(x) = \sqrt{R^2 + \frac{a}{\pi\sqrt{x}}},$$

where a is a constant that is chosen by the designer. The successful function r(x) is one where the derivative of $V^2$ with respect to x is a constant. By using the chain rule, we can calculate the derivative, as follows:

$$\frac{d(V^2)}{dx} = \frac{d(V^2)}{dA}\frac{dA}{dr}\frac{dr}{dx}$$

Each term of the right is:

$$\frac{d(V^2)}{dA} = \frac{-2Q^2}{A^3}$$

$$\frac{dA}{dr} = 2\pi r$$

$$\frac{dr}{dx} = \frac{-a}{4r\sqrt{x^3}}$$

Things are made easier when we notice that:

$$A = \frac{a}{\sqrt{x}}$$

After combining we arrive at:

$$\frac{d(V^2)}{dx} = \left(\frac{Q}{a}\right)^2$$

We have shown that the derivative of $V^2$ with respect to x is a constant. Notice that the function r(x) does not exist for $x \leq 0$.

Figure 8:
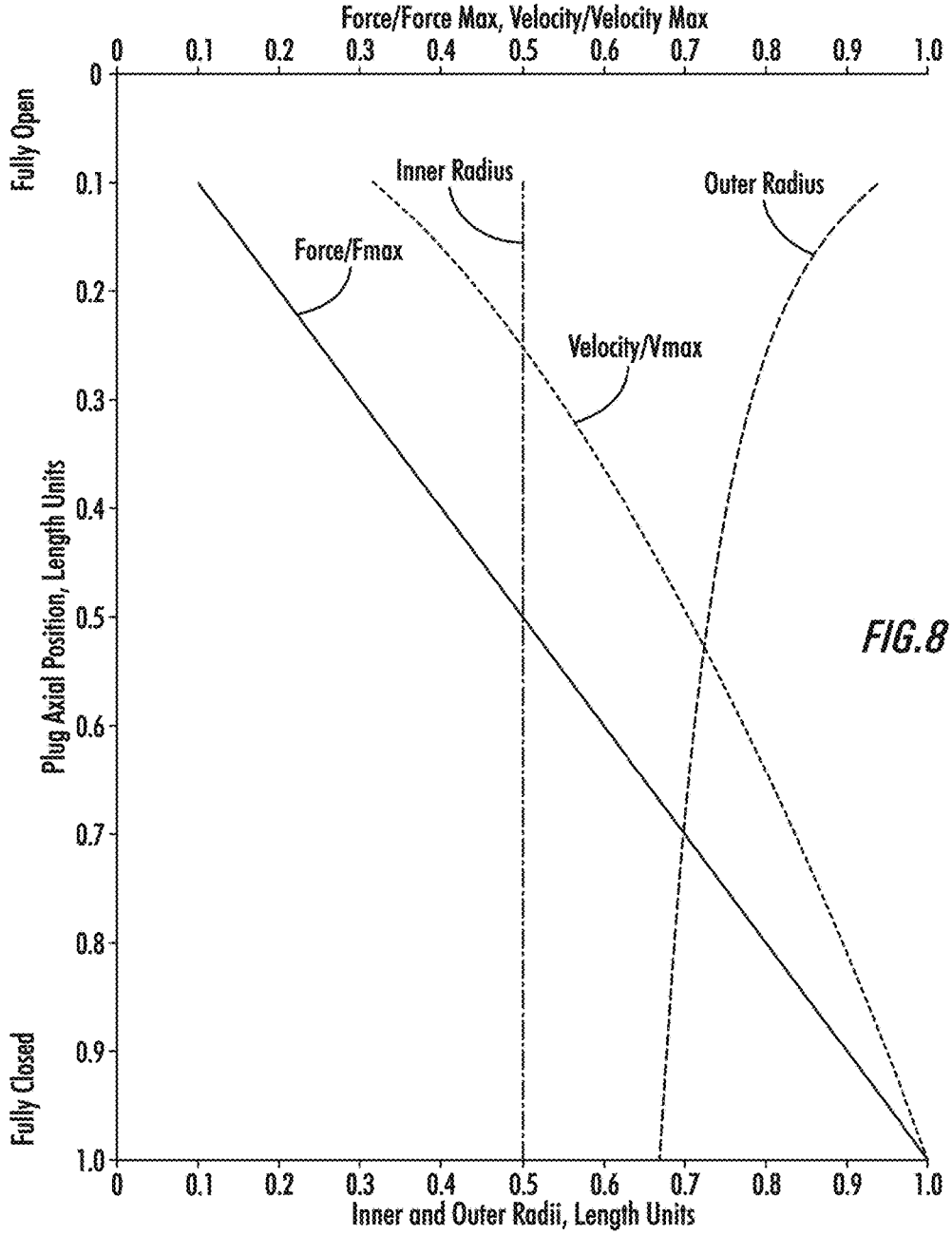
FIG. 8 is a graphical representation of the linear relationship between force and position as a feature of the present inventions.

Referring now to FIG. 8, a graphical representation illustrating the linear relationship between force and axial position is shown. In FIG. 8, the vertical axis represents the position of the plug. On the top, the plug is fully retracted and the difference between the outer and inner radii is large, thus the cross-sectional area is at its maximum. The velocity of fluid is slow, so the net force is low. Advancing the plug causes the outer radius to decrease, thus reducing the area, increasing the velocity which increases the force. When the outer radius of the stator varies according to the formula given above, the velocity increases with the square-root of the plug location and the force increases linearly until it reaches a maximum where the plug has fully advanced.

Figure 7:
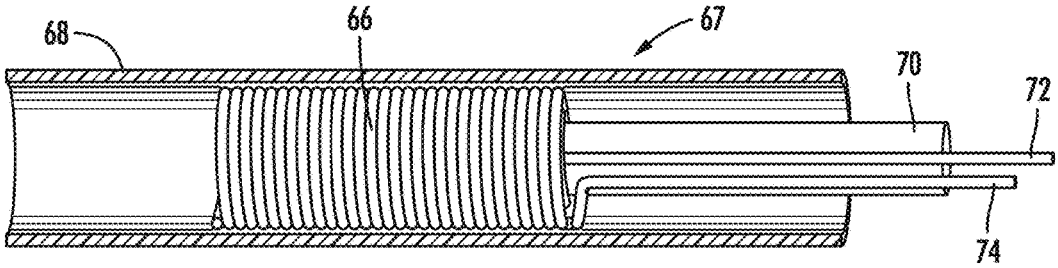
FIG. 7 is a cross-sectional side view of a solenoid-based embodiment of a variable resistance apparatus in accordance with the present inventions.

Referring now to FIG. 7, as an alternative to the fluid-based variable resistance apparatus 10 discussed above, a variable resistance apparatus 67 may include a solenoid 66 disposed for movement within a non-ferromagnetic tube 68. The non-ferromagnetic tube 68 may be secured to a solid support, such as the frame of an item of exercise equipment. The solenoid 66 may be connected to a distal end of a non-conductive rod 70, and the opposite end of the non-conductive rod 70 may be connected to a second support, such as like the handles 148. The solenoid 66 includes a first electrical wire 72 connected to a source of electricity. The solenoid 66 also includes a second electrical wire 74 connected to the controller 64. As the handles 148 push the non-conductive rod 70 and attached solenoid 66 back and forth with the non-ferromagnetic tube 68, the current detected at the controller 64 will increase as the rod 70 and solenoid 66 move faster within the non-ferromagnetic tube 68, and will decrease as the rod 70 and solenoid 66 move slower within the non-ferromagnetic tube 68. As the current increases, the force of the magnetic field of the solenoid 66 increases which will increase the resistance that the user of the item of exercise equipment will experience. By varying the current, the weight or resistance presented to the user of the exercise equipment is likewise varied. As the rod 70 moves faster, the resistance will go up. As the rod 70 is slowed down, the resistance will go down. The speed measurement device 56 including the wheel 58 as shown in FIG. 6 may be mounted so that the wheel 58 is in contact with the non-conductive rod 70 to measure the speed at which the non-conductive rod 70 is moving during the exercise. The speed measurement device 56 is in communication with the controller 64. In a specific embodiment, the controller 56 adjusts the current to the solenoid 66 based on the detected speed of the rod 70 to thereby adjust the resistance force experienced by the user of the exercise equipment. The goal is to keep the rod going the same speed.

Figure 9:
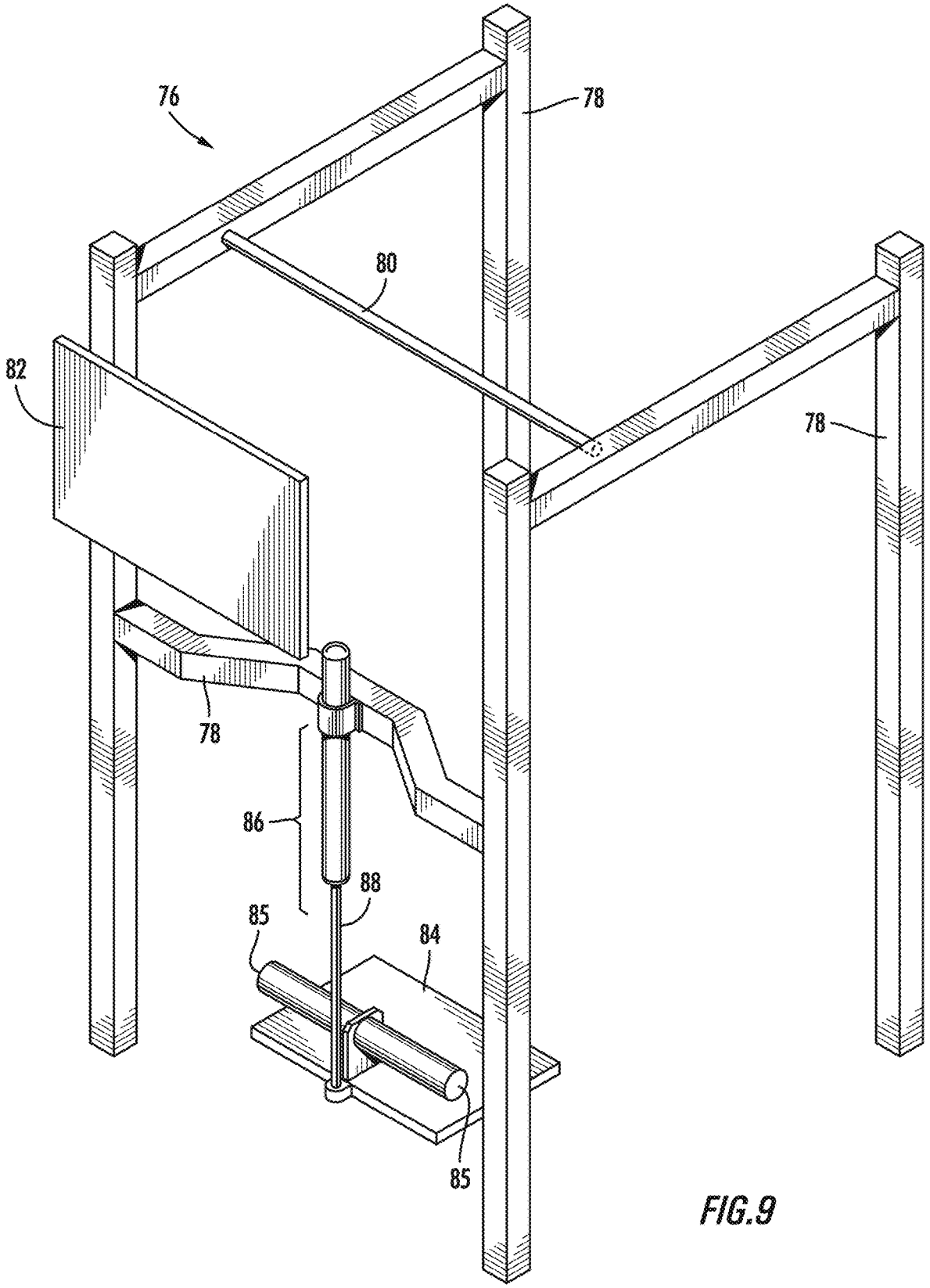
FIG. 9 is a perspective view of a specific embodiment of a first exercise apparatus constructed in accordance with one aspect of the present inventions.

The various embodiments of variable resistance devices as disclosed herein are useful in connection with a variety of systems and applications. By way of non-limiting example, one such application may be for use with exercise equipment. With reference to FIG. 9, a perspective view is shown of a first exercise apparatus 76 including a frame 78, an overhead bar 80, a monitor 82, a standing platform 84, and a specific embodiment of a variable resistance apparatus 86 connected to the standing platform 84 and to the frame 78. The standing platform 84 includes foot supports 85 attached to and spaced above the standing platform 84. As discussed above, the variable resistance apparatus 86 may include a longitudinal rod 88 and an enclosed housing 90. The longitudinal rod 88 may be adapted for telescoping and rotatable movement relative to the enclosed housing 90, as more fully discussed above. A person wishing to use the first exercise apparatus 76 may stand on the standing platform 84 with the tops of the person's feet positioned under the foot supports 85. The person then grabs the overhead bar 80 and lifts the person's feet up into contact with the foot supports 85 and raises the foot supports 85 upwardly under resistance of the variable resistance apparatus 86. The person can then push down on the standing platform 84 to exercise different muscles on the way down.

The present inventions may include a visual feedback system. For example, in the first exercise apparatus 76 shown in FIG. 9, the controller 64 may be in electrical communication with the monitor 82 and programmed to visually show the user the amount of force being applied by the user on a graph of force to position. In a specific embodiment, the monitor 82 gives the user of the exercise equipment real-time feedback of the user's effort. An example of what such a graph may look like is shown on the display 65 shown in FIG. 6. In a specific embodiment, the monitor 82 may be used to show the user real time feedback of the user's effort as a function of resistance force and position of some component of the equipment, such as the plug 32 or the handles 148, for example. The controller 64 may also be programmed to show a graph of the user's best performance of the exercise and/or a running average of recent attempts. The monitor 82 may allow the user to view and ascertain their current effort and may also see immediate comparisons to their previous history of performing the given exercise (e.g., graphed side by side with the user's current performance), even in real-time as the exercise is being performed. In this manner, the user may be provided instant feedback on how their current effort compares with their previous effort. The user's range-of-motion over time can be assessed using data relating to position and force over time. In a specific embodiment, for each exercise performed, whether on the first exercise apparatus 76 or another item of equipment, such as those discussed below, the maximum power, maximum force and total work may be recorded, such as in a memory 308 as discussed below in connection with the computer 64 and FIG. 18. This aspect is further described below in connection with FIGS. 15-17. In a specific embodiment, an exercise machine in accordance with the present inventions may include a way for a user to sign into the machine, such as using a PIN or some biometric feature (e.g., eyeball scan, fingerprint scanner, etc.). The machine may be adapted to access stored data for that user's history of exercising on the given machine, and then use that data to present feedback to the user on the monitor 82 as discussed above.

In a specific embodiment, one of the unique aspects of the present inventions is that the resistance is provided as a reaction to the user's effort at all points in the exercise path. With current methods, the user must select the resistance in advance and any variations in resistance are predetermined by the geometry of the exercise machine and the kinematics of the user's musculoskeletal system. For example, the present inventions are different than using a dumbbell or traditional exercise machine where the amount of resistance remains fixed throughout the exercise, unlike in the present inventions where the user can change the resistance and effort at any point during the exercise.

Figure 10:
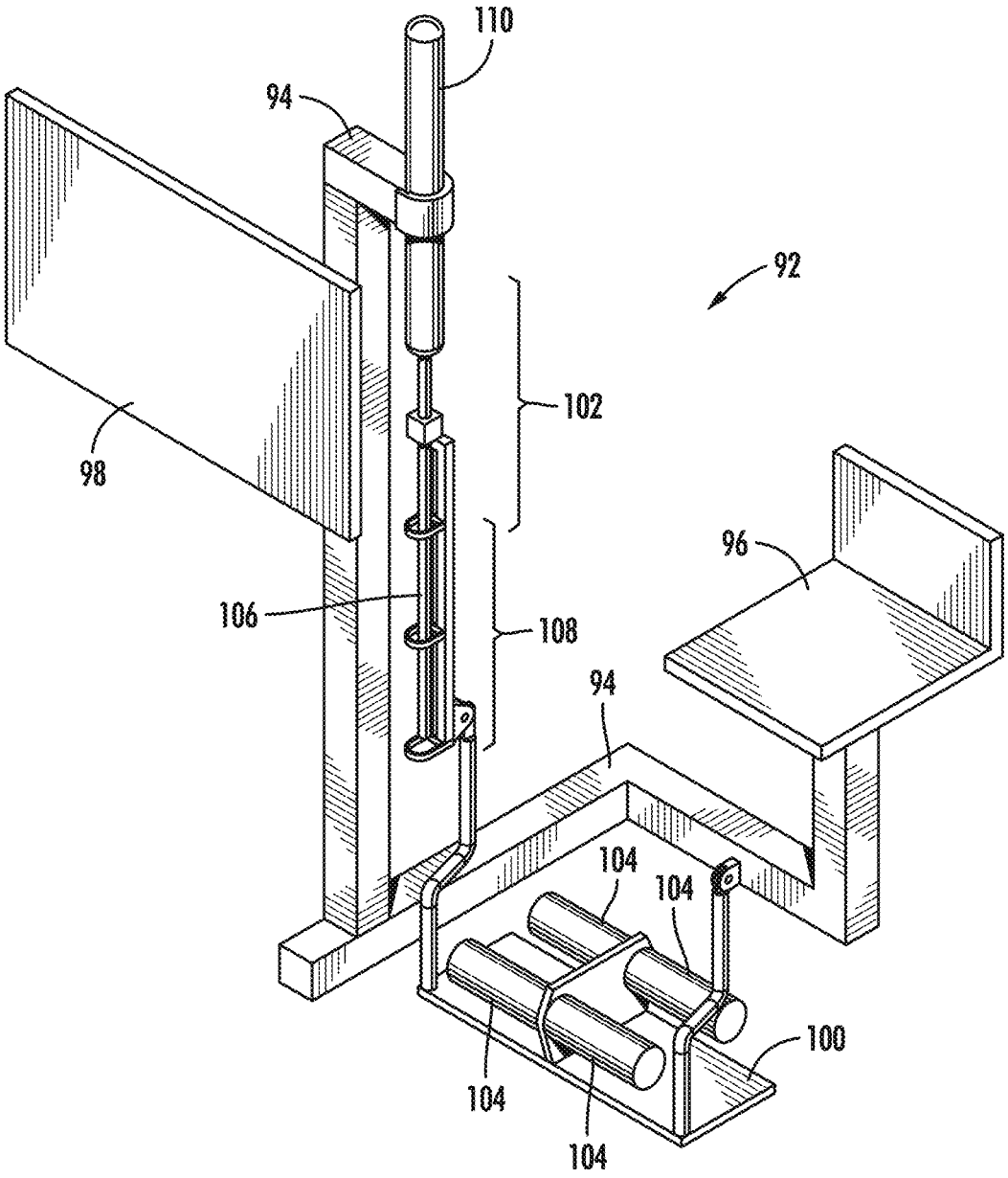
FIG. 10 is a perspective view of a specific embodiment of a second exercise apparatus constructed in accordance with one aspect of the present inventions.

FIG. 10 shows a second exercise apparatus 92 having a frame 94, a seat 96, a monitor 98, a foot platform 100, and a specific embodiment of a variable resistance apparatus 102 connected to the foot platform 100 and to the frame 94. A rack and pinion apparatus 108 may be used to facilitate connection and movement of the variable resistance apparatus 102 and the foot platform 100. The foot platform 100 includes foot supports 104 attached to and spaced above the foot platform 100. As discussed above, the variable resistance apparatus 102 may include a longitudinal rod 106 and an enclosed housing 110. The longitudinal rod 106 may be adapted for telescoping and rotatable movement relative to the enclosed housing 110, as more fully discussed above. A person wishing to use the second exercise apparatus 92 may sit on the seat 96 with the tops of the person's feet positioned under either the forward or rearward set of foot supports 104. The person then lifts the person's legs against the resistance of the variable resistance apparatus 102 to exercise the person's legs. Again, as discussed above, the monitor 98 here (and the other monitors discussed below) may function in the same way as explained above, such as to provide real-time feedback to the user during the exercise.

Figure 11:
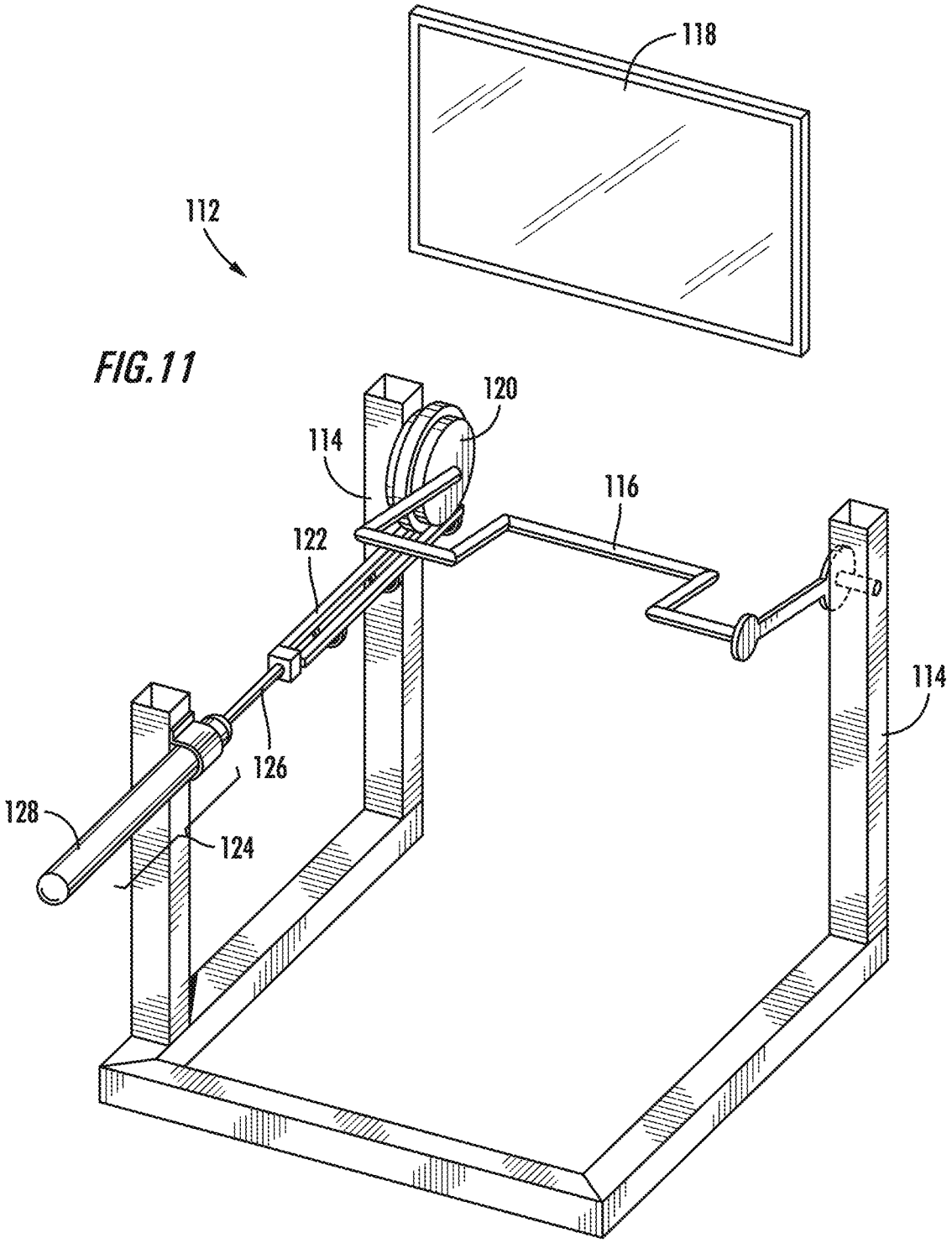
FIG. 11 is a perspective view of a specific embodiment of a third exercise apparatus constructed in accordance with one aspect of the present inventions.

FIG. 11 shows a third exercise apparatus 112 having a frame 114, a curl bar 116 rotatably mounted to the frame 114, a monitor 118, a pinion 120 mounted to the frame 114 and connected to the curl bar 116, a rack 122 connected to the pinion 120 and to a specific embodiment of a variable resistance apparatus 124. The variable resistance apparatus 124 may include a longitudinal rod 126 connected to the rack 122, and an enclosed housing 128. The longitudinal rod 126 may be adapted for telescoping and rotatable movement relative to the enclosed housing 128, as more fully discussed above. A person wishing to use the third exercise apparatus 112 may stand behind the curl bar 116 and grab the handles of the curl bar 116 and perform bicep curls against the resistance of the variable resistance apparatus 124 to exercise the person's arms.

Figure 12:
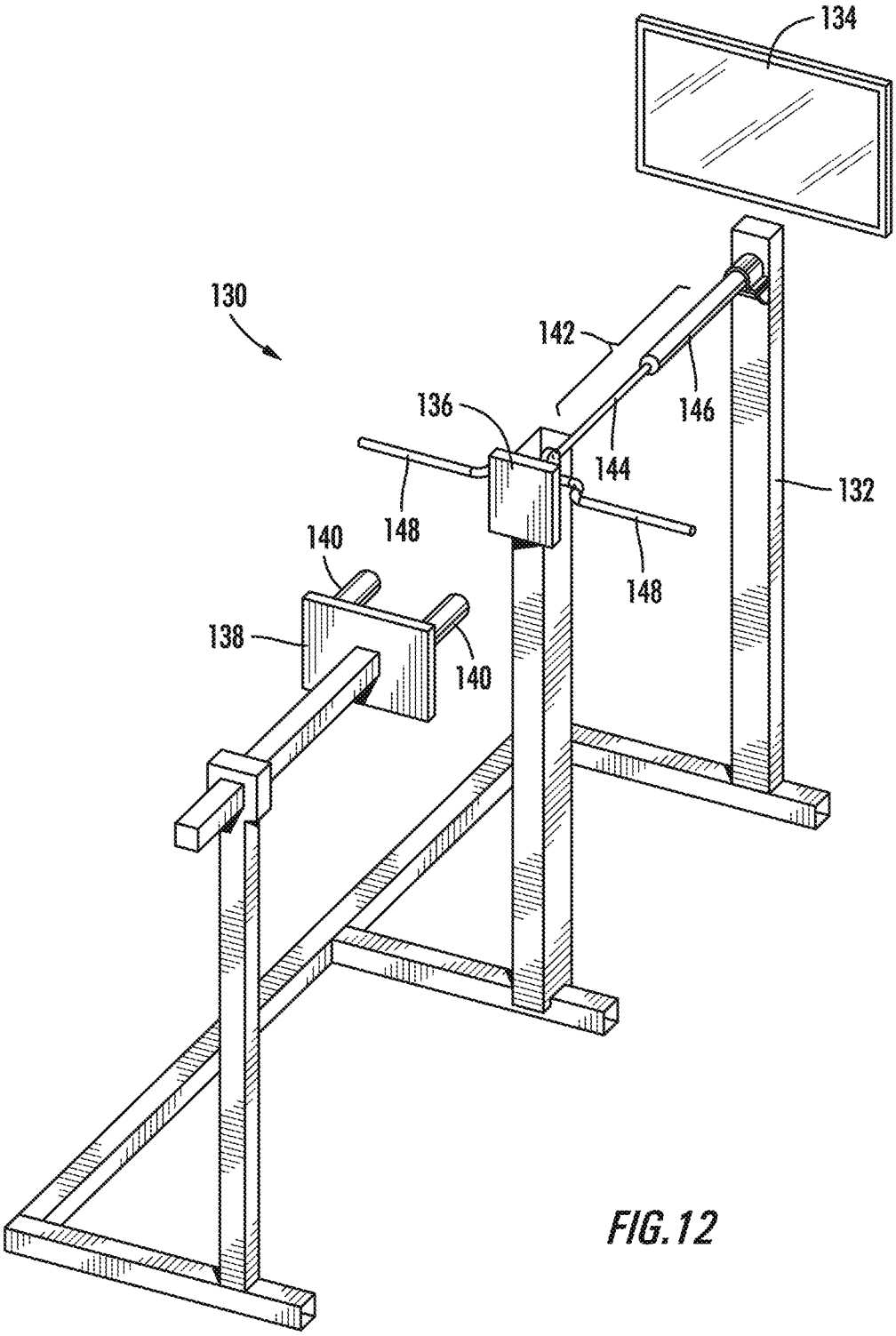
FIG. 12 is a perspective view of a specific embodiment of a fourth exercise apparatus constructed in accordance with one aspect of the present inventions.

FIG. 12 shows a fourth exercise apparatus 130 having a frame 132, a monitor 134, a chest plate 136, a back rest 138, spaced neck supports 140 attached to the back rest 138, and a specific embodiment of a variable resistance apparatus 142 connected to the frame 132. The variable resistance apparatus 142 may include a longitudinal rod 144 and an enclosed housing 146. The longitudinal rod 144 may be adapted for telescoping and rotatable movement relative to the enclosed housing 146, as more fully discussed above. The rod 144 may include handles 148 positioned adjacent the chest plate 136. A person wishing to use the fourth exercise apparatus 130 may stand facing the chest plate 136 and with the person's back against the back rest 138 with the person's head between the neck supports 140. The person may then grab the handles 148 and push and pull against the resistance of the variable resistance apparatus 142 to exercise the person's chest, arms, and back.

Figure 13:
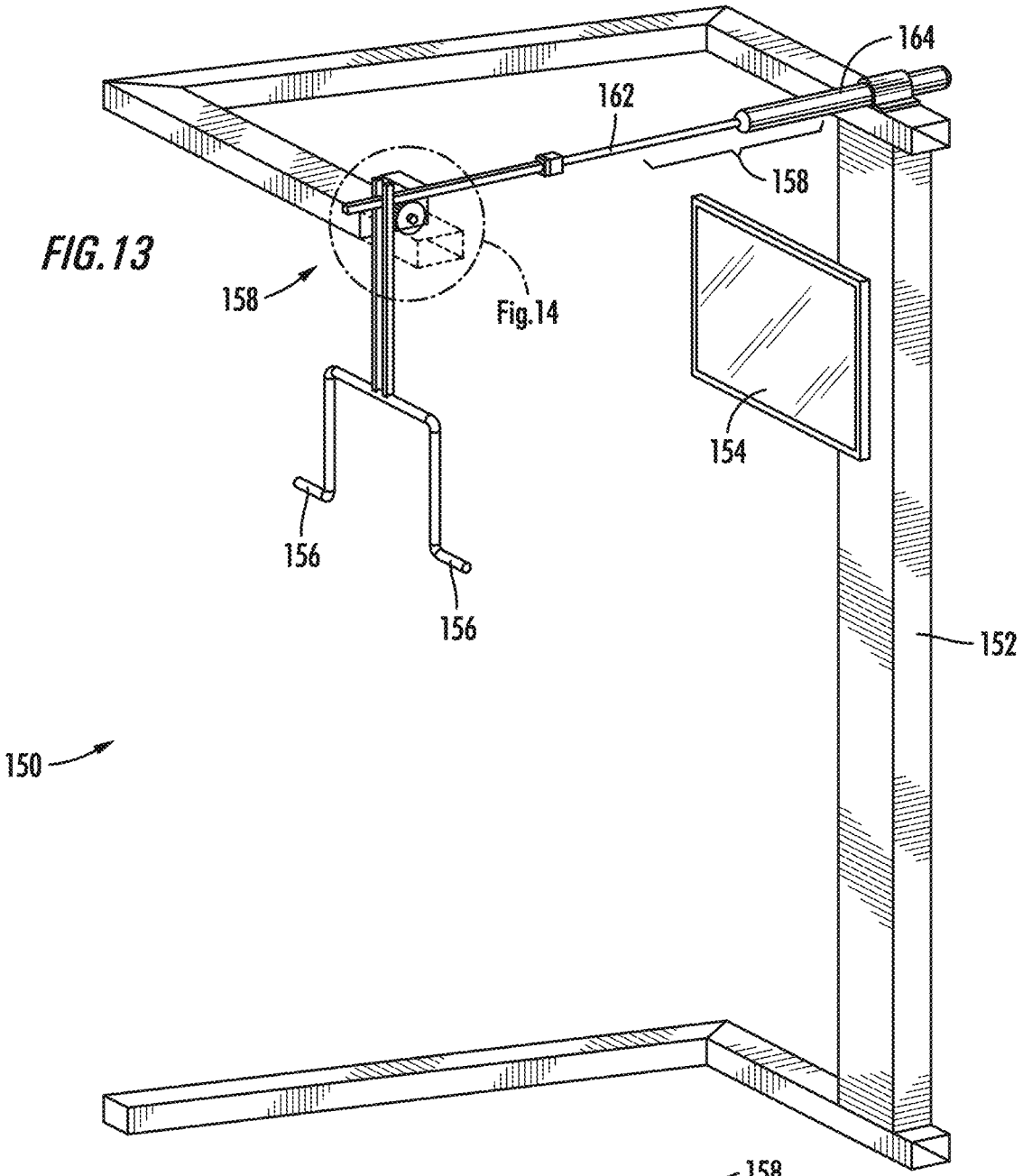
FIG. 13 is perspective view of a specific embodiment of a fifth exercise apparatus constructed in accordance with one aspect of the present inventions.
Figure 14:
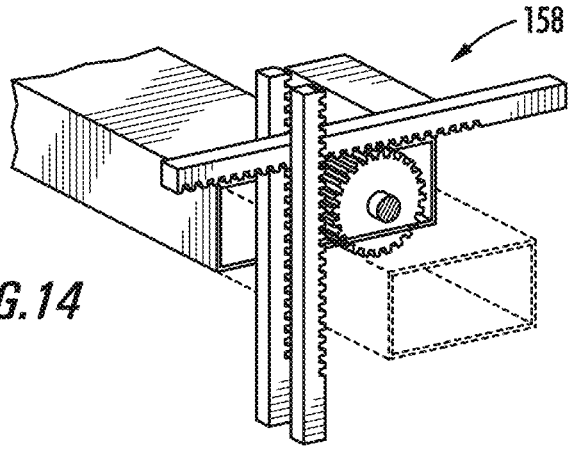
FIG. 14 is an enlarged view of a specific portion of the exercise apparatus shown in FIG. 13.

FIG. 13 shows a fifth exercise apparatus 150 having a frame 152, a monitor 154, and a set of handles 156 connected via a rack and pinion apparatus 158 (further shown in FIG. 14) to a specific embodiment of a variable resistance apparatus 158 connected to the frame 152. The variable resistance apparatus 158 may include a longitudinal rod 162 and an enclosed housing 164. The longitudinal rod 162 may be adapted for telescoping and rotatable movement relative to the enclosed housing 164, as more fully discussed above. A person wishing to use the fifth exercise apparatus 150 may grab the handles 156 and exercise the person's arms and shoulders by pushing the handles 156 up and pulling them down against the resistance of the variable resistance apparatus 160.

In practice, the person using the exercise equipment will determine the amount of weight the person is lifting or pushing based on how fast the person is pushing or pulling on the handles that are attached to the variable resistance apparatus 10. As the longitudinal rod 14 is pushed faster, the speed will be communicated to the controller 64, which in turn will cause the motor 36 to rotate the rod 14 and the rotor 30 to move the plug 32 down toward its closed position and thereby increase the force and thus the weight or resistance force that the person exercising must push or pull. By the same token, as the person exercising pushes or pulls the handles more slowly, this speed reduction will result in the plug 32 being moved upwardly toward its open position, which will reduce the resistance force to the person exercising. Again, as discussed above, one of the unique aspects of the present inventions is that the resistance is variably provided as a reaction to the user's effort at all points along the exercise path, which is unlike the current state of the art for exercise equipment where the resistance is a fixed amount for the duration of the exercise.

In another embodiment, the present inventions may be adapted for use as part of cardio exercise equipment. In this embodiment, the present inventions may include a computer adapted to interface with a heart rate monitor to modulate the force to maintain the user's heart rate in a pre-determined range. For example, a cardio embodiment may be incorporated as a rowing machine where the pull stroke may be modulated to keep the user's heart rate in the range and then the valve could be fully opened on the push stroke to allow for easy return on that phase, which simulates actual rowing.

Figure 15:
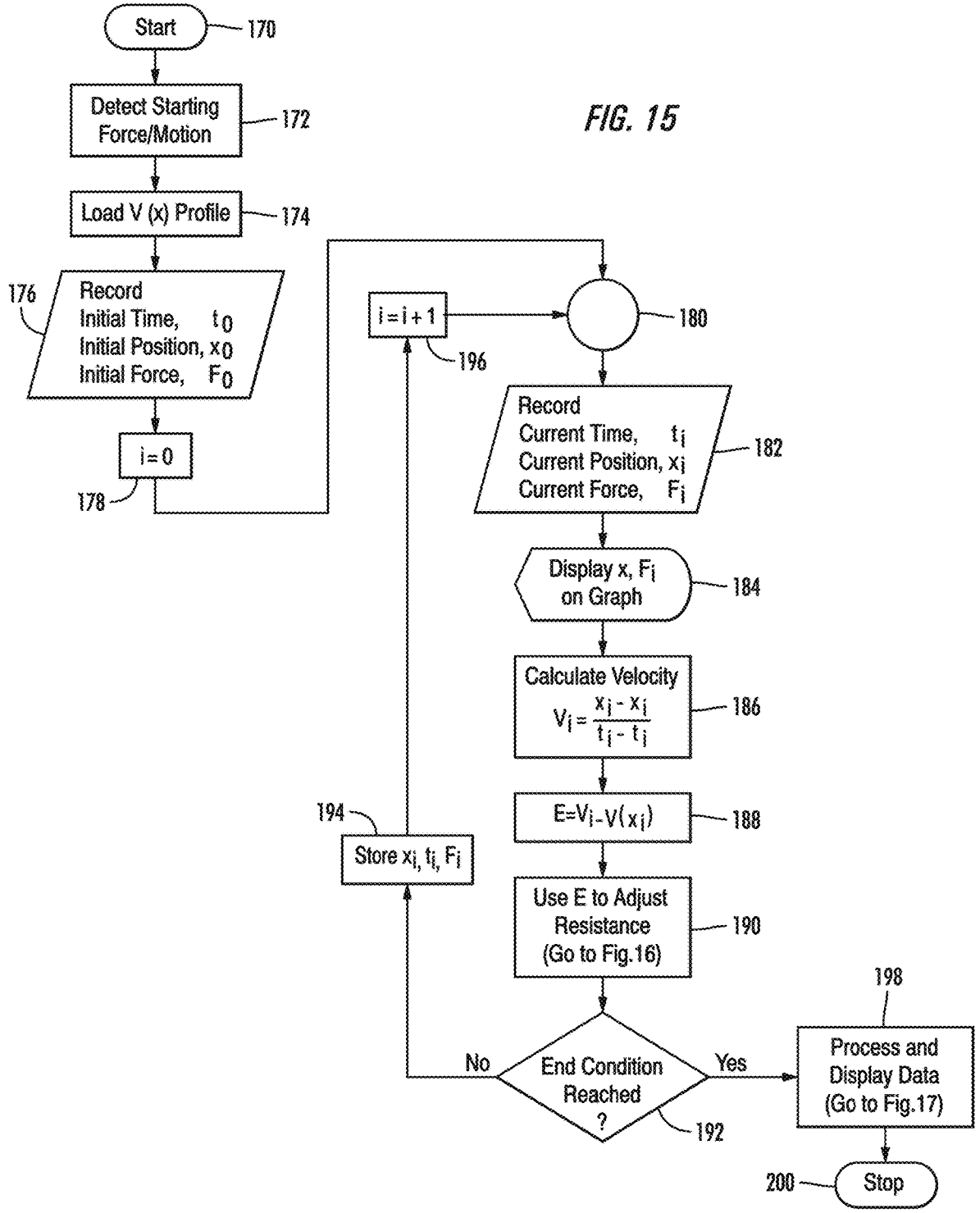
FIG. 15 is a flow chart illustrating a specific embodiment of a process in accordance with one aspect of the present inventions.

Referring now to FIG. 15, a specific embodiment of a process encompassed by the present inventions is illustrated as a flow chart. At step 170, the process begins. Next, at step 172, the process detects a starting force/motion (e.g., when a person sits and grabs the handles of an item of exercise equipment and starts moving the handles). The force may be detected by the load cell 69 shown in FIG. 6. Next, at step 174, the process loads a velocity profile that is a function of x position. Next, at step 176, the process records the initial time, the initial position, and the initial force. Next, at step 178, a counter is set to zero. Next, at step 180, the process commences an iterative loop. Next, at step 182, the process records the current time, current position, and current force. Next, at step 184, the process may display force and position on a graph, such as shown on display 65 in FIG. 6. This may be used during an exercise so the user can see the current position and force in real time to provide instant feedback to the user. Next, at step 186, the process calculates velocity. Next, at step 188, an error E is calculated by determining the difference between the actual velocity and the target velocity. Next, at step 190, the process uses the error E to adjust the resistance. In a specific embodiment, this may be done by the process shown in FIG. 16, as described below. In a specific embodiment, the error E may be used to determine how to rotate the longitudinal rod 14 to move the plug 32 up or down within the lower housing 38 of the stator 22 (such as shown in FIG. 2). Next, at step 192, the process determines whether the end condition has been reached (e.g., has the user finished an exercise). If no, then the process proceeds in a loop back toward step 180. In that process of going from step 192 to step 180, the process may, at step 194, store the current time, position and force, and then at step 196, advance the step counter by 1. The process then goes back through steps 182-192 until the answer at step 192 is yes, at which time the process proceeds to step 198 to process and display data, after which the process stops at step 200. A specific embodiment of a process for processing displaying data at step 198 is illustrated in the flow chart at FIG. 17, as described below.

Figure 16:
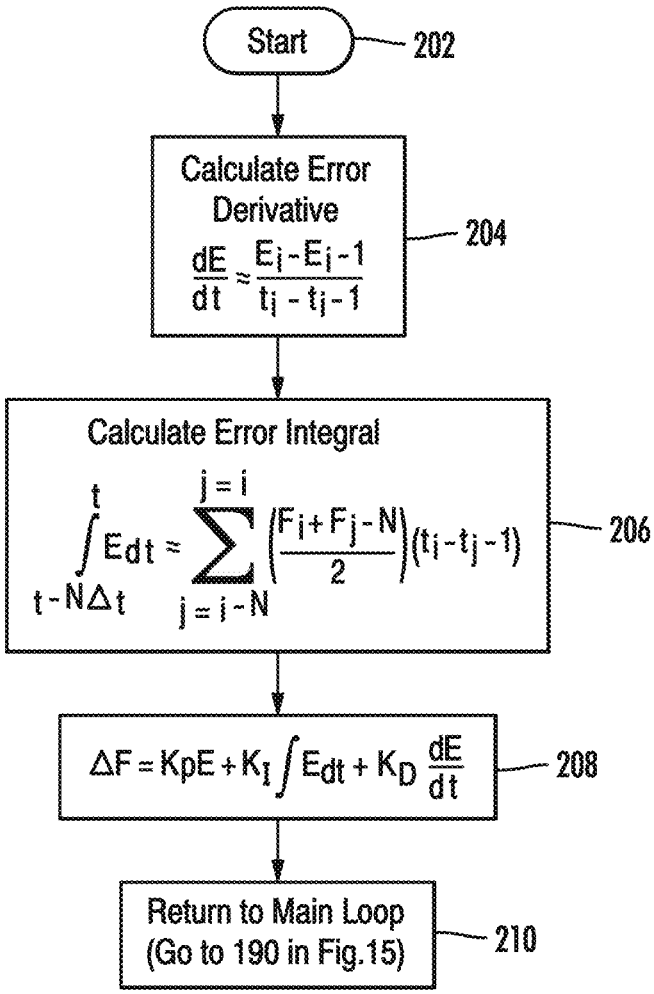
FIG. 16 is a flow chart illustrating a specific embodiment of another process in accordance with another aspect of the present inventions.

Referring back to step 190 in FIG. 15, where an error E is used to adjust resistance, a process for determining an error E will now be described with reference to FIG. 16. As mentioned above, an error E is the difference between the current velocity and the target velocity. In the specific embodiment shown in FIG. 16, a process for determining an error E commences at step 202. Next, at step 204, the process may calculate an error derivative. Next, at step 206, the process may calculate an error integral, where N is the number of past time steps. Next, at step 208, the process may calculate a force change signal, where $K_P$, $K_I$ and $K_D$ are constants to be tuned. Next, at step 210, the process may return to the main loop, e.g., step 190 in FIG. 15.

Figure 17:
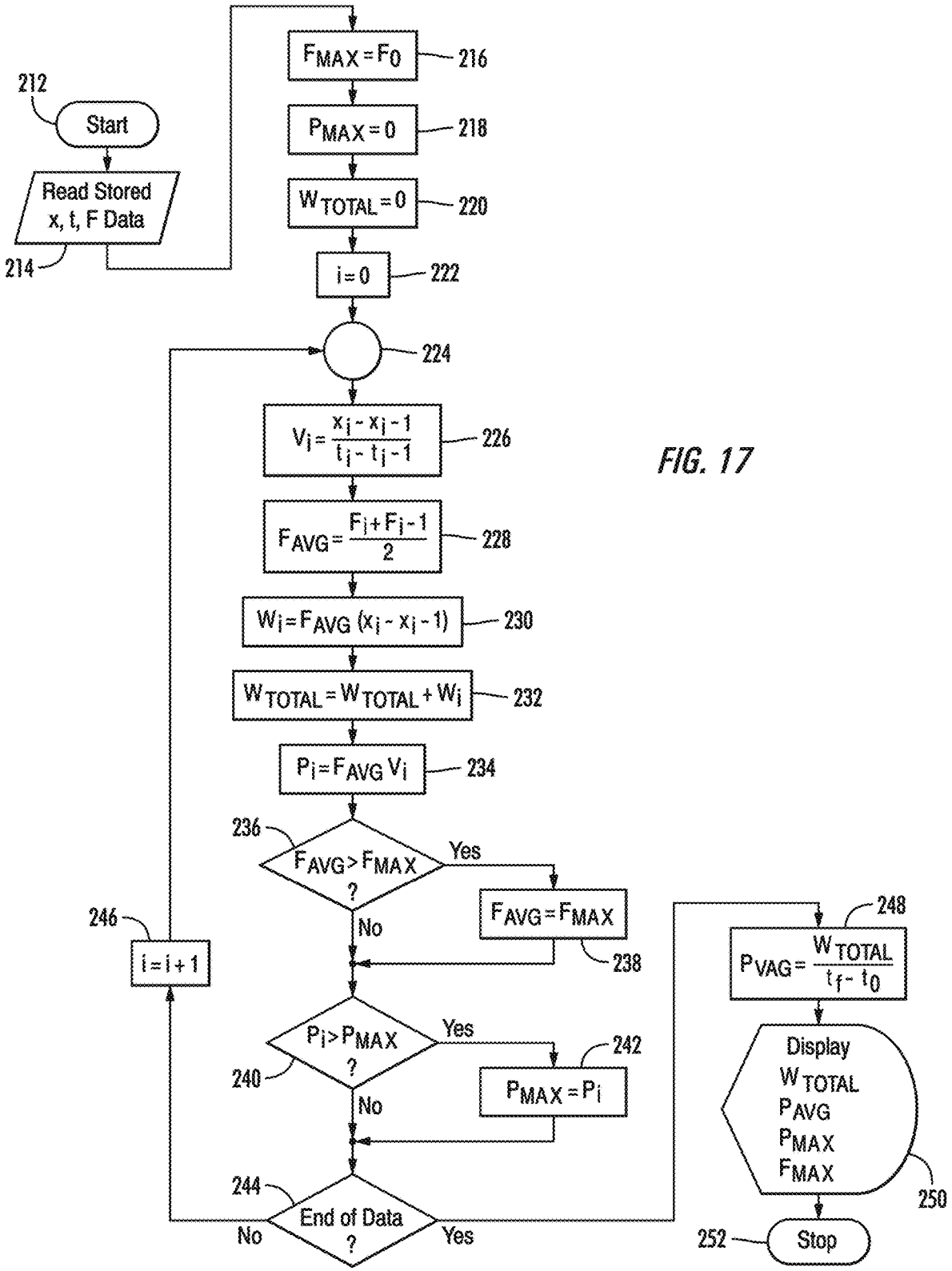
FIG. 17 is a flow chart illustrating a specific embodiment of another process in accordance with another aspect of the present inventions.

Referring back to step 198 in FIG. 15, a process for processing and displaying data when an end condition is met will now be described with reference to FIG. 17. It is noted that an end condition could occur for example at the top of the upstroke on a military/shoulder press exercise machine, such as shown in FIG. 13. In the specific embodiment of a process for processing and displaying data as shown in FIG. 16, the process may start at step 212. Next, at step 214, the process may read the stored data for x (position), time and force. Next, at step 216, the initial force is set to the maximum force read from the stored data. Next, at step 218, the maximum power P is set to zero. Next, at step 220, the total work W is set to zero. Next, at step 222, a step counter is set to zero. Next, at step 224, an iterative loop is initiated. Next, at step 226, the process calculates the current velocity. Next, at step 228, the process calculates an average velocity. Next, at step 230, the current work completed is calculated. Next, at step 232, the total work is calculated. Next, at step 234, the instantaneous power is calculated, which is the product of average force and current velocity. Next, at step 236, the process determines whether the average force is greater than the maximum force. If yes, then at step 238 the process sets the average force equal to the maximum force. If the answer at step 236 is no, then the process proceeds to step 240 to determine whether the current power is greater than the maximum power. If yes, then the maximum power is set equal to the current power at step 242. If the answer at step 240 is no, then the process proceeds to step 244 to determine if all data has been processed. If no, then the process proceeds to step 246 to increase the step counter and then moves back to step 224 and back through steps 226-244. Once the answer at step 244 is yes, then the process moves to step 248 to calculate the average power. Next, at step 250, the process displays total work, average power, maximum power, and maximum force. Next, at step 252, the process ends.

Computer Architecture

The present inventions can be realized in hardware, software, or a combination of hardware and software. In a specific embodiment, a system according to the present inventions can be realized in a centralized fashion in one computer system, or in a distributed fashion where different elements are spread across several interconnected computer systems. Any kind of computer system or other apparatus adapted for carrying out the methods and inventions described herein may be used for purposes of the present inventions. A typical combination of hardware and software could be a general-purpose computer system with a computer program that, when being loaded and executed, controls the computer system such that it carries out the methods and inventions described herein.

The figures herein include block diagram and flowchart illustrations of methods, apparatus(s) and computer program products according to various embodiments of the present inventions. It will be understood that each block in such figures, and combinations of these blocks, can be implemented by computer program instructions. These computer program instructions may be loaded onto a computer or other programmable data processing apparatus to produce a machine, such that the instructions which execute on the computer or other programmable data processing apparatus may be used to implement the functions specified in the block, blocks or flow charts. These computer program instructions may also be stored in a computer-readable medium or memory that can direct a computer or other programmable data processing apparatus to function in a particular manner, such that the instructions stored in the computer-readable medium or memory produce an article of manufacture including instructions which may implement the function specified in the block, blocks or flow charts. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the block, blocks or flow charts.

Those skilled in the art should readily appreciate that programs defining the functions of the present inventions can be delivered to a computer in many forms, including but not limited to: (a) information permanently stored on non-writable storage media (e.g., read only memory devices within a computer such as ROM or CD-ROM disks readable by a computer I/O attachment); (b) information alterably stored on writable storage media (e.g., floppy disks and hard drives); or (c) information conveyed to a computer through communication media for example using wireless, baseband signaling or broadband signaling techniques, including carrier wave signaling techniques, such as over computer or telephone networks via a modem, or via any of the networks included within the systems discussed above.

Referring now to FIG. 18, a diagram is shown illustrating an example of a computer or controller 64 that may be used in connection with the present inventions. The computer 64 may include at least one processor 306 and at least one memory 308, each of which may be coupled to a local interface or bus 310.

An operating system 312 may be stored in the memory 308 and executable by the processor 306. Any variety of software programs 314 may also be stored in the memory 308 and executable by the processor 306. In a specific embodiment, examples of programs that may be stored in the memory 308 and executable by the processor 306 may include one or more programs that may implement the functionality described hereinabove in connection with FIGS. 1-17. A media player application 316 may be stored in the memory 308 and executable by the processor 306. Also stored in the memory 306 may be various forms of data.

The term "executable" as used herein means that a program file is of the type that may be run by the processor 306. In specific embodiments, examples of executable programs may include without limitation: a compiled program that can be translated into machine code in a format that can be loaded into a random access portion of the memory 308 and run by the processor 306; source code that may be expressed in proper format such as object code that is capable of being loaded into a random access portion of the memory 308 and executed by the processor 306; or source code that may be interpreted by another executable program to generate instructions in a random access portion of the memory 308 to be executed by the processor 306. An executable program may be stored in any portion or component of the memory 308 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 308 may include both volatile and nonvolatile memory and data storage components. Volatile components are those that do not retain data values upon loss of power. Nonvolatile components are those that retain data upon a loss of power. Thus, the memory 308 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

In a specific embodiment, the processor 306 may represent multiple processors 306 and/or multiple processor cores and the memory 308 may represent multiple memories 306 that operate in parallel processing circuits, respectively. In such a case, the local interface 310 may be an appropriate network that facilitates communication between any two of the multiple processors 306, between any processor 306 and any of the memories 308, or between any two of the memories 308, etc. The local interface 310 may comprise additional systems designed to coordinate this communication, including, for example, performing load balancing. The processor 306 may be of electrical or of some other available construction.

Although the programs and other various systems, components and functionalities described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits (ASICs) having appropriate logic gates, field-programmable gate arrays (FPGAs), or other components. Such technologies are generally well known by those skilled in the art and, consequently, are not described in detail herein.

The flowcharts within FIGS. 1-17 show the functionality and operation of various specific embodiments of certain aspects of the present inventions. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 306 in a computer system or other system. The machine code may be converted from the source code, etc. If embodied in hardware, each block may represent a circuit or a number of interconnected circuits to implement the specified logical function(s).

Although the flowcharts within FIGS. 1-17 may show a specific order of execution, it is understood that the order of execution may differ from that which is depicted. For example, the order of execution of two or more blocks may be scrambled relative to the order shown. Also, two or more blocks shown in succession in the flow charts within FIGS. 1-17 may be executed concurrently or with partial concurrence. Further, in some embodiments, one or more of the blocks shown within FIGS. 1-17 may be skipped or omitted. In addition, any number of counters, state variables, warning semaphores, or messages might be added to the logical flow described herein, for purposes of enhanced utility, accounting, performance measurement, or providing troubleshooting aids. It is understood that all such variations are within the scope of the present inventions.

Any logic or application described herein that comprises software or code can be embodied in any non-transitory computer-readable medium, such as computer-readable medium 318 shown in FIG. 18, for use by or in connection with an instruction execution system such as, for example, a processor 306 in a computer system or other system. In this sense, the logic may comprise, for example, statements including instructions and declarations that can be fetched from the computer-readable medium 318 and executed by the instruction execution system. In the context of the present inventions, a "computer-readable medium" may include any medium that may contain, store, or maintain the logic or application described herein for use by or in connection with the instruction execution system.

The computer-readable medium 318 may comprise any one of many physical media such as, for example, magnetic, optical, or semiconductor media. More specific examples of a suitable computer-readable medium 318 would include, but are not limited to, magnetic tapes, magnetic floppy diskettes, magnetic hard drives, memory cards, solid-state drives, USB flash drives, or optical discs. Also, the computer-readable medium 318 may be a random access memory (RAM) including, for example, static random access memory (SRAM) and dynamic random access memory (DRAM), or magnetic random access memory (MRAM). In addition, the computer-readable medium 318 may be a read-only memory (ROM), a programmable read-only memory (PROM), an erasable programmable read-only memory (EPROM), an electrically erasable programmable read-only memory (EEPROM), or other type of memory device.

The computer 64 may further include a network interface 320 coupled to the bus 310 and in communication with a communication network 16. The network interface 320 may be configured to allow data to be exchanged between computer 64 and other devices attached to a communication network 166 or any other network or between nodes of any computer system or a system. For example, in a specific embodiment, a person using exercise equipment in accordance with the present inventions may wirelessly connect the person's mobile telephone or other device loaded with a mobile application or other software and adapted for wireless communication with the computer 64 to relay exercise or other data to the person's mobile or other device. The communication network 166 may in various embodiments include one or more networks including but not limited to Local Area Networks (LANs) (e.g., an Ethernet or corporate network), Wide Area Networks (WANs) (e.g., the Internet), wireless data networks, some other electronic data network, or some combination thereof. In various embodiments, the network interface 320 may support communication via wired or wireless general data networks, such as any suitable type of Ethernet network, for example; via telecommunications/telephony networks such as analog voice networks or digital fiber communications networks; via storage area networks such as Fibre Channel SANs, or via any other suitable type of network and/or protocol.

The computer 64 may also include an input/output interface 322 coupled to the bus 310 and also coupled to one or more input/output devices, such as a display 324 (or the display 65 discussed above), a touchscreen 326, a mouse or other cursor control device (e.g., television remote control) 328, and/or a keyboard 330. In certain specific embodiments, further examples of input/output devices may include one or more display terminals, keypads, touchpads, scanning devices, voice or optical recognition devices, or any other devices suitable for entering or accessing data by one or more computers 64. Multiple input/output devices may be present with respect to a computer 64 or may be distributed on various nodes of computer system, a system and/or any of the devices discussed above. In some embodiments, similar input/output devices may be separate from the computer 64 and may interact with the computer 64 or one or more nodes of computer system through a wired or wireless connection, such as through the network interface 320.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. A variable resistance apparatus comprising:

a sealed, enclosed housing having a first end and containing a fluid, a sleeve having a first end secured to the first end of the enclosed housing, and extending into the enclosed housing, a longitudinal rod having a first end and a second end, the longitudinal rod being disposed for rotatable and telescoping movement within the sleeve, a stator disposed within the enclosed housing and fluid, an upper end of the stator being connected to a second end of the sleeve, the stator having a lower housing including a tapered internal bore, a threaded rotor disposed within the stator, the threaded rotor being connected to the second end of the longitudinal rod, a plug disposed within the stator and fluid, the plug having an upper opening, an internal bore, and an enclosed lower end, the internal bore including internal threads adapted for threadable engagement with the threaded rotor, a motor mounted adjacent the first end of the sleeve and connected to the first end of the longitudinal rod, the motor being adapted to impart rotational movement to the longitudinal rod, wherein rotation of the longitudinal rod in a first direction will cause the threaded rotor to rotate in a first direction and cause the plug to move downwardly within the tapered internal bore in the lower housing of the stator, and rotation of the longitudinal rod in a second direction will cause the threaded rotor to rotate in a second direction and cause the plug to move upwardly relative to the tapered internal bore in the lower housing of the stator.

2. The variable resistance apparatus of claim 1, wherein the tapered internal bore of the lower housing on the stator yields a linear relationship between change in force and change in longitudinal movement of the plug within the lower housing of the stator.

3. The variable resistance apparatus of claim 1, further including at least one guide rod connected to an upper end of the plug and disposed for reciprocating movement within a guide bore in an upper plate of the stator.

4. The variable resistance apparatus of claim 1, further including a monitor to display force versus time.

5. The variable resistance apparatus of claim 1, wherein an increase in speed of telescoping movement of the sleeve will cause the motor to rotate the longitudinal rod in the first direction to increase resistance force, and a decrease in speed of telescoping movement of the sleeve will cause the motor to rotate the longitudinal rod in the second direction to decrease resistance force.

6. The variable resistance apparatus of claim 5, further including a controller to control rotatable movement of the longitudinal rod to control the position of the plug relative to the tapered internal bore of the lower housing in the stator based on speed of the sleeve as it moves.

7. A variable resistance valve comprising:

a sealed housing filled with a fluid;

a stator disposed within the housing and fluid, and having a lower housing including a tapered internal bore; and a plug disposed for longitudinal movement within the stator relative to the tapered internal bore;

wherein the tapered internal bore of the lower housing on the stator yields a linear relationship between change in force and change in longitudinal movement of the plug within the lower housing of the stator.

8. The variable resistance valve of claim 7, further including a rotatable rod having a threaded end threadably engaged with an internal threaded bore of the plug, wherein rotation of the rod causes longitudinal movement of the plug within the tapered internal bore of the lower housing of the stator.

9. The variable resistance valve of claim 7, wherein the position of the plug within the stator varies based on how fast the stator and plug are moving together in unison.

* * * * *